United States Patent [19]

Burgett

[11] Patent Number: 4,666,332

[45] Date of Patent: May 19, 1987

[54] METHOD AND APPARATUS FOR REPOSITIONING TRAFFIC BARRIERS

[76] Inventor: William B. Burgett, Rt. #3, Lost Run Rd., Fredericktown, Ohio 43019

[21] Appl. No.: 882,259

[22] Filed: Jul. 7, 1986

[51] Int. Cl.[4] ..... E01F 13/00

[52] U.S. Cl. ..... 404/6; 404/12; 404/72

[58] Field of Search ..... 404/6, 9, 12, 13, 72; 256/1, 13.1

[56] References Cited

U.S. PATENT DOCUMENTS

| | | | |
|---|---|---|---|
| 2,000,974 | 5/1935 | Mead | 256/1 |
| 2,287,685 | 6/1942 | Jelinek | 404/12 |
| 2,931,279 | 4/1960 | Wiswell | 404/13 |
| 3,245,327 | 4/1966 | Wasley | 404/12 |
| 3,391,620 | 7/1968 | Mahoney | 404/6 |
| 3,958,890 | 5/1976 | Ferrari | 404/9 |
| 4,004,857 | 1/1977 | Eschen, Jr. | 404/6 |
| 4,017,200 | 4/1977 | Woods, Jr. | 404/6 |
| 4,474,503 | 10/1984 | Booth et al. | 404/6 |
| 4,498,803 | 2/1985 | Quittner | 404/6 |
| 4,500,225 | 2/1985 | Quittner | 404/6 |

FOREIGN PATENT DOCUMENTS

| | | | |
|---|---|---|---|
| 559969 | 7/1958 | Canada | 404/12 |
| 2562575 | 10/1985 | France | 404/12 |

*Primary Examiner*—Stephen J. Novosad
*Assistant Examiner*—John F. Letchford
*Attorney, Agent, or Firm*—Allen D. Gutchess, Jr.

[57] ABSTRACT

A traffic barrier carrier or mover is provided, by means of which traffic barrier sections can be repositioned according to changing needs. The carrier includes a supporting frame having two opposite end plates upon which adjacent ends of two generally aligned barrier sections are supported. The frame carries a hydraulic cylinder which raises and lowers supporting wheels mounted on an axle under the frame. The wheels are moved between an upper position located above the lower extremities of the supporting frame with the barrier sections being supported on a surface, and a lower position below the lower extremities of the supporting frame with the barrier sections being raised above the surface. In the latter position of the wheels, the barrier sections can be towed in end-to-end relationship from one position to another. Steering mechanism can be employed with the wheels of each carrier to steer the barrier sections.

18 Claims, 4 Drawing Figures

METHOD AND APPARATUS FOR REPOSITIONING TRAFFIC BARRIERS

This invention relates to a traffic barrier carrier or mover by means of which traffic barrier sections can be repositioned.

Traffic barriers used in road construction are commonly made of cast concrete, being in the order of ten feet long, thirty inches high, and approximately twenty-four to about thirty inches wide, and weighing in the order of one and one-half tons. The barrier sections are positioned by means of a crane in end-to-end relationship and pinned together at the ends. Because of their size and weight, the barrier sections usually remain in position until the road construction is completed.

The present invention provides a traffic barrier carrier or mover which is positioned between adjacent ends of traffic barrier sections which are located in end-to-end relationship. The carriers raise the sections and enable them to be towed in train-like fashion from one location to another. This enables the traffic barrier sections to be moved out of the way on weekends, for example, when no construction is taking place. The barrier sections can also be progressively moved along a highway, as needed, when lanes thereof are being paved, to give protection to the workmen. They can also be employed for bi-directional traffic and moved as needed, during construction projects on multi-lane highways.

The traffic barrier carrier or mover according to the invention includes a heavy duty supporting frame having end frame members positioned to be adjacent ends of two barrier sections. Low, horizontal end plates extend outwardly from the end frame members on which adjacent ends of the barrier sections are engaged and supported. An intermediate frame member extends between the end frame members and carries a vertically-disposed, fluid-operated ram. The sides of the supporting frame can have suitable plates or panels affixed thereto to provide continuity in the surfaces from one barrier section to the next.

Two spaced wheels are rotatably carried by an axle which is connected to a piston in a cylinder of the ram. The ram moves the wheels between a first, upper position which is above the lower extremities of the supporting frame and a second, lower position below the lower extremities of the supporting frame. With the wheels in the upper position, the barrier sections rest on the ground and on the end plates of the carrier. With the wheels in the lower position, the barrier sections and end plates are raised above the ground and the barrier sections are in a condition for being moved from one location to another. This can be accomplished by a tractor, bulldozer, or the like which is connected to one end of a series of the sections and tows them to another location.

A steering shaft can extend above the supporting frame of the carrier and be connected to the wheel axle through the piston of the ram. In this manner, the shaft can be turned to turn the axle and the wheels so as to individually steer the barrier carriers. The steering shafts can be connected together through suitable linkages or rods for this purpose.

Traffic barriers have been mounted on wheels before, as shown in French Pat. No. 72.01432 and U.S. Pat. No. 2,000,974. They have also been moved about on overhead rails as shown in U.S. Pat. Nos. 4,474,503; 4,498,803; and 4,500,225. The barriers have also been moved transversely on conveyor arrangements as shown in U.S. Pat. No. 3,391,620. However, all of these previous arrangements have had various disadvantages or lacked versatility in the degree of movement.

It is, therefore, a principal object of the invention to provide an improved traffic barrier carrier or mover and method of operation having the features and advantages set forth above.

Many other objects and advantages of the invention will be apparent from the following detailed description of a preferred embodiment thereof, reference being made to the accompanying drawings, in which.

Figure 1:
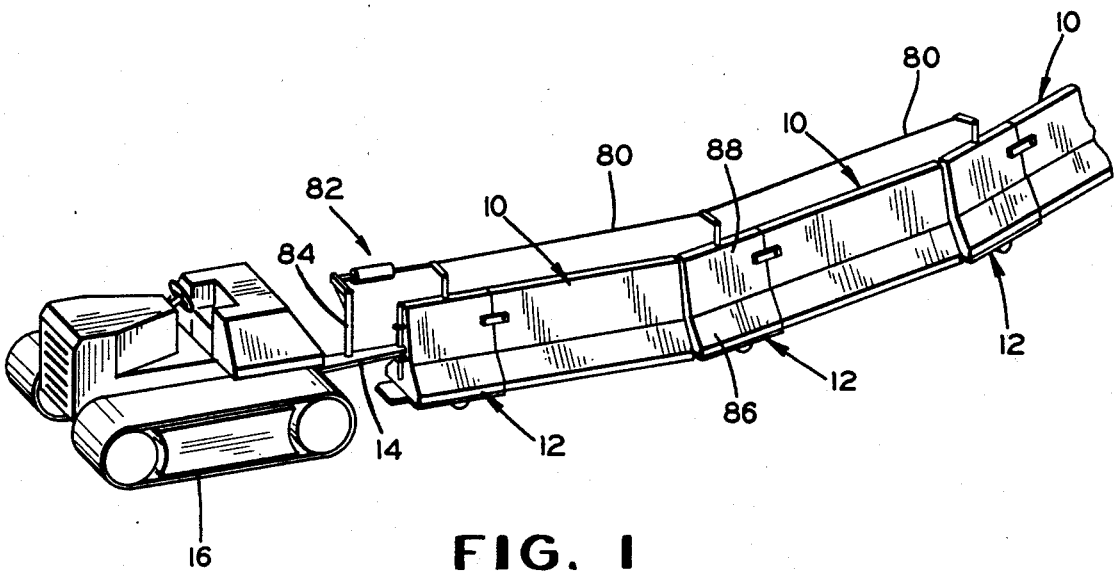
FIG. 1 is a schematic view in perspective of a plurality of traffic barrier sections mounted on carriers and being towed by a suitable vehicle.

Referring to the drawings and particularly to FIG. 1, a plurality of traffic barrier sections 10 are shown being moved in end-to-end relationship from one location to another. Between ends of the barrier sections 10 are traffic barrier carriers or movers 12 in accordance with the invention. The front carrier 12 can be connected by a tow bar 14 to a suitable towing vehicle 16 whereby the traffic barrier sections and carriers can be towed in a train-like fashion to a new position, as needed. Heretofore, the barrier sections, being of substantial size and weight as discussed earlier, were placed in position by a crane and left in that position until construction was complete.

Figure 2:
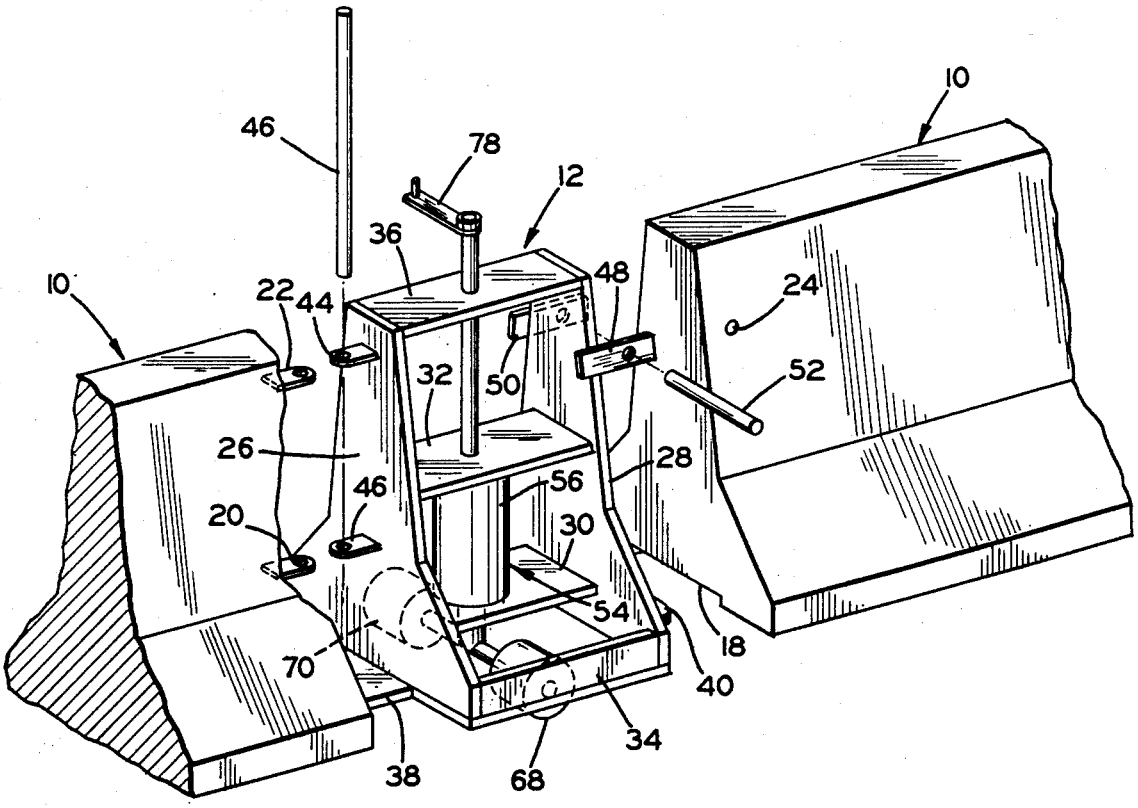
FIG. 2 is a somewhat schematic fragmentary view in perspective of two traffic barrier sections with a carrier or mover therebetween.
Figure 3:
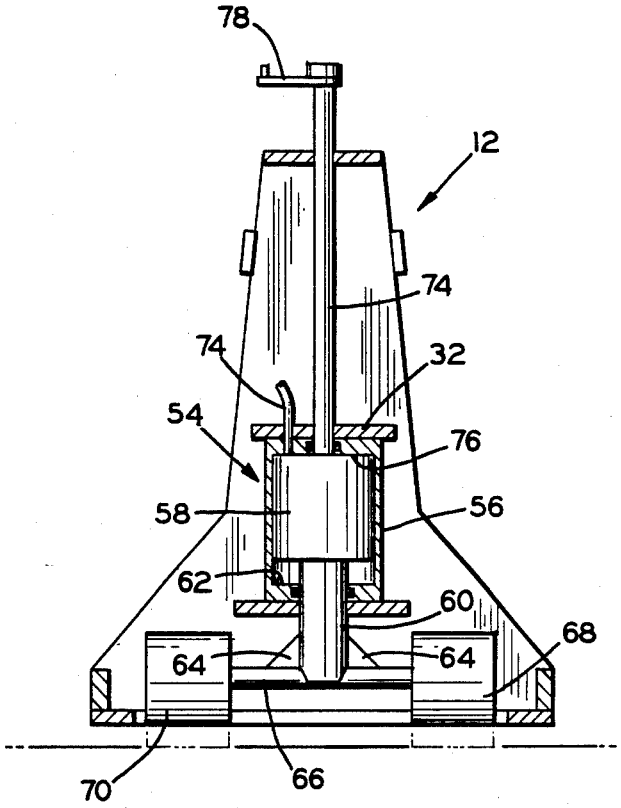
FIG. 3 is a somewhat schematic transverse view in cross section taken through the traffic barrier carrier shown in FIG. 2.
Figure 4:
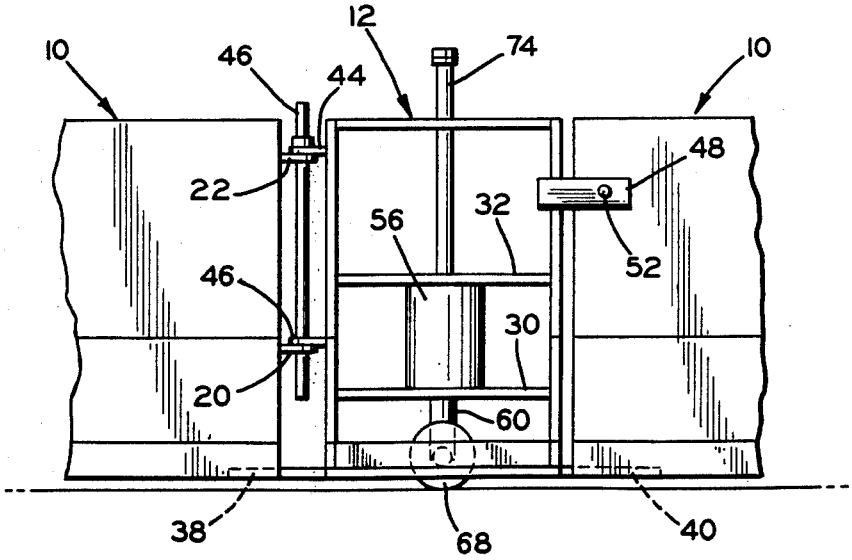
FIG. 4 is a somewhat schematic, fragmentary side view in elevation of the carrier and two barrier sections of FIG. 2.

While the designs of the traffic barrier sections vary according to the manufacturer, they typically have a longitudinallyextending shallow recess 18 in the bottom surface thereof, as shown in FIG. 2. Connecting eyes 20 and 22 are also often molded into at least one end of the barrier section so that the sections can be pinned together when placed in substantially contiguous, end-to-end relationship. In this instance, one end of the barrier section 10 also has a transverse, horizontal bore or passage 24 formed therein.

The barrier carrier 12 includes a supporting frame having two end frame members 26 and 28 and are of the approximate transverse size and shape of the barrier sections. Two intermediate, horizontally-disposed frame members 30 and 32 extend between intermediate portions of the end frame members 26 and 28. The carrier frame also includes lower and upper frame members 34 and 36 providing additional structural support.

Lifting plates or tongues 38 and 40 extend outwardly beyond the end frame members 26 and 28 and are positioned adjacent the ground or other supporting surface when the carrier is in a lower position. The lifting plates 38 and 40 can be slightly narrower than the shallow recesses 18 in the sections 10 when such recesses are provided. Otherwise, the plates can be wider, if desired, to extend substantially the width of the bottoms of the sections 10.

The end frame member 26 can have horizontally-extending connecting eyes 42 and 44 positioned near the level of the section eyes 20 and 22 so that the carrier 12 can be pivotally connected to the end of the barrier section through the eyes by a vertical connecting pin or rod 46. The end plate 28 has outwardly-extending tabs 48 and 50 which are rigidly connected to the one barrier section 10 by a horizontal pin or rod 52 extending through holes in the tabs 48 and 50 and through the bore 24. In this manner, the barrier carrier 12 is rigidly connected to the right-hand barrier section 10 and is pivotally connected to the left-hand barrier section 10.

A fluid-operated ram 54 is carried by the barrier carrier 12 and specifically has a cylinder 56 mounted between the intermediate frame members 30 and 32. A piston 58 is located in the cylinder with a heavy-duty piston rod 60 extending downwardly through an end plate 62 of the cylinder 56 and through an opening in the frame member 30. The lower end of the piston rod 60 is affixed through suitable gusset plates 64 to an axle 66 rotatably carrying wheels 68 and 70. When fluid under pressure is supplied through a line 72 to the upper end of the cylinder 56, the piston rod 60 moves downwardly, moving the wheels 68 and 70 downwardly to raise the barrier carrier 12 and the barrier sections 10 when they are engaged by and supported on the lifting plates 38 and 40. A distance of about four inches is all that is required for the wheels 68 and 70 to travel to raise the barrier sections a sufficient distance above the ground whereby they can be transported.

In order to move the barrier sections 10 in other than a straight line, the barrier carriers 12 are provided with a steering arrangement. For this purpose, a vertical shaft 74 is affixed to the upper end of the piston 58 and extends upwardly through an upper end plate 76 of the cylinder 56 and through the frame members 32 and 36. A transverse arm 78 is affixed to an upper end of the steering shaft 76 and extends to the side thereof. When the arm 78 is turned, it accordingly turns the piston 58, the piston rod 60, the axle 66 and the wheels 68 and 70 to provide transverse movement of the adjacent barrier sections. The arm 78 can be steered together by connecting linkages 80 (FIG. 1) which are connected to a piston rod of a hydraulic ram 82 mounted on the towing vehicle support 84 extending upwardly from the tow bar 14. The arms can also be individually manipulated, as by individual hydraulic cylinders or by rack and pinions, to provice the desired direction for the barrier sections during towing.

As shown in FIG. 1, the carriers 12 can have side panels or plates 86 and 88 fastened to the end plates 26 and 28 to provide continuity for the surfaces of the barrier sections 10. The carriers 12 remain connected to the adjacent barrier sections 10 when moved to the new location.

Various modifications of the above-described embodiment of the invention will be apparent to those skilled in the art and it is to be understood that such modifications can be made without departing from the scope of the invention, if they are within the spirit and the tenor of the accompanying claims.

I claim:

1. A traffic barrier carrier adapted to be positioned between ends of two traffic barrier sections to aid in raising and transporting the sections from one location to another, said carrier comprising a supporting frame including two end frame members positioned to be adjacent ends of the two barrier sections, and at least one intermediate frame member extending between said end frame members, means extending beyond said end frame memers for engaging and supporting end portions of said barrier sections, a fluid-operated ram having a cylinder carried by said intermediate frame member, a piston in said cylinder, piston rod means affixed to said piston and extending below said cylinder and said intermediate frame member, axle means afffixed to a lower end portion of said piston rod means, spaced wheels rotatably carried by said axle means, said wheels having a first, upper position above lower extremities of said supporting frame and a second, lower position below the lower extremities of said supporting frame, and connecting means carried by said supporting frame for attaching said supporting frame to the end portions of the barrier sections.

2. A traffic barrier carrier according to claim 1 characterized by steering means affixed to said piston and extending above said supporting frame for turning said piston, said axle means, and said wheels about a generally vertical axis.

3. A traffic barrier carrier according to claim 1 characterized by said end frame members being substantially of the same size and shape as a transverse cross section taken through the traffic barrier sections.

4. A traffic barrier carrier according to claim 3 characterized by panels positioned between said end frame members for providing continuity for the surfaces of the traffic barrier sections when said traffic barrier carrier is positioned between the two traffic barrier sections.

5. A traffic barrier carrier according to claim 1 characterized by said connecting means being effective to pivotally attach said supporting frame to the end portion of one of the barrier sections.

6. A traffic barrier carrier according to claim 1 characterized by said extending means comprising two horizontally disposed supporting plates adapted to be received under lower surfaces of the barrier sections.

7. In combination, two traffic barrier sections having ends in generally parallel, spaced relationship, a traffic barrier carrier positioned between said ends of said sections to aid in raising and transporting said sections from one location to another, said carrier having a supporting frame, means carried by said supporting frame for engaging and supporting said ends of said barrier sections, wheel means movably carried by said supporting frame, and moving means mounted on said supporting frame and connected to said wheel means for moving said wheel means between an upper position in which said barrier sections are supported on a surface and a lower position in which said ends of said barrier sections are raised above the surface.

8. The combination according to claim 7 characterized by said carrier having means extending above said supporting frame for steering said wheel means.

9. The combination according to claim 8 characterized by said steering means being connected to said wheel means through said moving means.

10. The combination according to claim 7 characterized by said moving means comprising a fluid-operated ram connected to said wheel means.

11. The combination according to claim 10 characterized by a steering shaft affixed to said fluid-operated ram for turning at least a portion of said fluid-operated ram and said wheel means about a generally vertical axis.

12. The combination according to claim 7 characterized by means connected to said supporting frame for connecting said supporting frame to said ends of said barrier sections.

13. The combination according to claim 12 characterized by said connecting means pivotally connecting said carrier to one of said barrier sections to enable limited pivotal movement between said carrier and said one barrier section about a generally vertical axis.

14. The combination according to claim 7 characterized by said supporting frame having panels affixed thereto to provide continuity between side surfaces of said traffic barrier sections.

15. A method of manipulating elongate traffic barrier sections which comprises supporting adjacent ends of generally aligned barrier sections on wheeled barrier carriers, extending wheels below said carriers to raise the adjacent ends of the barrier sections above the ground, and towing the barrier sections in end-to-end relationship from one location to another.

16. A method according to claim 15 characterized by turning said wheels when the barrier sections are being towed to provide a degree of transverse movement of the barrier sections relative to their longitudinal extent.

17. A method according to claim 15 characterized by connecting the wheeled barrier carriers to the adjacent ends of the barrier sections prior to towing the barrier sections.

18. A method according to claim 15 characterized further by raising the wheels when the barrier sections are in the another location to enable said barrier sections to be supported on the ground.

* * * * *